US009570802B2

(12) United States Patent
Miyagawa et al.

(10) Patent No.: US 9,570,802 B2
(45) Date of Patent: Feb. 14, 2017

(54) RADAR ANTENNA AND RADAR ANTENNA MANUFACTURING METHOD

(71) Applicant: Furuno Electric Co., Ltd., Nishinomiya (JP)

(72) Inventors: Tetsuya Miyagawa, Nishinomiya (JP); Koji Atsumi, Nishinomiya (JP); Kazuyoshi Furugori, Nishinomiya (JP); Makoto Oda, Nishinomiya (JP)

(73) Assignee: Furuno Electric Co., Ltd., Nishinomiya (JP)

( * ) Notice: Subject to any disclaimer, the term of this patent is extended or adjusted under 35 U.S.C. 154(b) by 163 days.

(21) Appl. No.: 14/088,308

(22) Filed: Nov. 22, 2013

(65) Prior Publication Data

US 2014/0145907 A1 May 29, 2014

(30) Foreign Application Priority Data

Nov. 27, 2012 (JP) ..... 2012-258704

(51) Int. Cl.
*H01Q 1/12* (2006.01)
*H01Q 3/04* (2006.01)

(52) U.S. Cl.
CPC ..... *H01Q 3/04* (2013.01); *Y10T 29/49016* (2015.01)

(58) Field of Classification Search
CPC ..... H01Q 1/1207; H01Q 1/12
USPC ..... 343/878
See application file for complete search history.

(56) References Cited

U.S. PATENT DOCUMENTS

| | | | | |
|---|---|---|---|---|
| 3,234,558 | A | 2/1966 | Borgiotti | |
| 7,358,909 | B2 * | 4/2008 | Sherwood | H01Q 1/084 343/713 |
| 2009/0315801 | A1 * | 12/2009 | Welsh | H01Q 3/08 343/841 |
| 2011/0122017 | A1 | 5/2011 | Vacanti | |

FOREIGN PATENT DOCUMENTS

| | | |
|---|---|---|
| GB | 642825 | 9/1950 |
| JP | S63227204 A | 9/1988 |
| JP | S60216605 A | 10/1995 |

OTHER PUBLICATIONS

"Consilium Selux ST Radar Line," Consilium AB, Accessed Nov. 14, 2013, 11 pages.

* cited by examiner

*Primary Examiner* — Graham Smith
(74) *Attorney, Agent, or Firm* — Alleman Hall McCoy Russell & Tuttle LLP

(57) ABSTRACT

A radar antenna is provided. The radar antenna includes an antenna unit provided with dielectric bodies in a front part thereof in a radio wave radiating direction, a pedestal, a supporting bar attached between the antenna unit and the pedestal to separate the antenna unit from the pedestal, and formed with a hollow section therein, and one of a cable and a waveguide passing through the hollow section and connected with the antenna unit.

12 Claims, 4 Drawing Sheets

RADAR ANTENNA AND RADAR ANTENNA MANUFACTURING METHOD

CROSS-REFERENCE TO RELATED APPLICATION(S)

This application claims priority under 35 U.S.C. §119 to Japanese Patent Application No. 2012-258704, which was filed on Nov. 27, 2012, the entire disclosure of which is hereby incorporated by reference.

TECHNICAL FIELD

The present invention relates to a radar antenna including an antenna unit having dielectric bodies.

BACKGROUND OF THE INVENTION

Conventionally, radar antennas each including an antenna unit and a housing unit has been known. The antenna unit radiates outside radio waves. The housing unit is built therein with a motor for rotating the antenna unit, a coaxial cable for supplying radio waves to the antenna unit, etc.

Moreover, various kinds of antenna units have conventionally been known, such as, an antenna unit having a shape in which the cross-section of an opening part thereof becomes gradually spreads wider toward outside (horn shape, trumpet shape). In supporting the horn-shaped antenna unit, it has been known that even if a metal is disposed right beneath or behind the horn part, it does not give any influence on a beam formation. Therefore, conventionally, in order to stably support the horn-shaped antenna unit, the antenna unit is generally substantially directly attached to the housing unit (with an attaching plate interposing therebetween).

Moreover, JP1991-042723A discloses an antenna unit having dielectric bodies. The antenna unit includes a dielectric body waveguide mechanism comprised of two dielectric body flat plates opposing to each other.

However, with the antenna unit having the dielectric bodies as disclosed in JP1991-042723A, when a metal is disposed near the antenna unit, a beam cannot be formed appropriately. Therefore, the antenna unit having the dielectric bodies is preferred not to be disposed near the housing body, which is different from the conventional horn-shaped antenna unit.

Therefore, the antenna unit having the dielectric bodies is preferred to be supported to be separated from the housing unit. However, in this case, it is concerned that a coaxial cable or the like connecting the antenna unit with the housing unit will be exposed outside.

Thus, an ultraviolet ray countermeasure is needed for the part of the coaxial cable exposed outside. Moreover, when applying to a ship radar apparatus, since it is concerned that the exposed cable receives seawater and a stress due to air pressure, a countermeasure for these factors is also needed. As a result, the manufacturing cost of the radar antennas increases.

Moreover, in the case where the coaxial cable is exposed outside, the appearance of the radar antenna will seem untidy and it is not preferable also in view of the design.

However, JP1991-042723A only discloses the configuration having the shape of the antenna unit with the dielectric bodies, and the details in connecting or protecting the coaxial cable and a waveguide are not disclosed.

SUMMARY OF THE INVENTION

The present invention is made in view of the above situations, and mainly aims to provide a radar antenna that protects a coaxial cable connecting an antenna unit with a housing unit, with a simple configuration.

One aspect of the present invention provides a radar antenna. The radar antenna includes an antenna unit, a pedestal, a supporting bar, and one of a cable and a waveguide. The antenna unit is provided with dielectric bodies in a front part thereof in a radio wave radiating direction. The supporting bar is attached between the antenna unit and the pedestal to separate the antenna unit from the pedestal, and is formed with a hollow section therein. One of a cable and a waveguide passes through the hollow section and is connected with the antenna unit.

Thus, since one of the cable and the waveguide is not exposed outside, the environmental resistance of the cable or the like can be improved. Additionally, since a member for protecting the cable can be omitted or simplified, a cost reduction can be achieved. Moreover, the contour of the radar antenna can be simplified.

The supporting bar may include a plurality of supporting bars. The hollow section may be formed in at least one of the plurality of supporting bars.

Generally, a hollow supporting bar has a less strength than a solid supporting bar. However, by supporting the antenna unit with the plurality of supporting bars as described above, the antenna unit can be supported stably. Particularly, even when wind blows toward the antenna, wind can pass through between the plurality of supporting bars, and therefore, the radar antenna can be stabilized.

At least one of the plurality of supporting bars may incline in a longitudinal direction of the antenna unit.

Thus, the antenna unit can be supported more stably compared to the configuration of supporting the center part of the antenna unit. Moreover, when the cable or the like is desired to be arranged on the end part side in the antenna unit in the longitudinal direction for example, since the cable or the like does not need to be bent sharply, a stress on the cable or the like can be reduced.

The supporting bar may include two supporting bars, and a gap between the supporting bars may become wider toward the antenna unit.

Thus, the antenna unit can be supported stably even if the number of supporting bars is two.

The antenna unit may be an end feed type. The hollow section of the supporting bar may contain a coaxial cable therein.

Thus, with the antenna unit of the end feed type, since the coaxial cable needs to be connected to the end part of the antenna in the longitudinal direction, the coaxial cable can be arranged by effectively utilizing the inclination of the supporting bars.

The radar antenna may also includes a housing unit formed with a hole. One of the cable and the waveguide may be disposed to pass through the hole formed in the housing unit, and the hollow section formed to penetrate the supporting bar.

Thus, the cable or the like disposed between the antenna unit and the housing is fully covered. Therefore, the environmental resistance of the cable or the like can be improved more.

The supporting bar may incline toward a rear part of the antenna unit in the radio wave radiating direction.

Generally, when the antenna supporting unit supports the antenna unit having the dielectric bodies, it supports a rear part of the antenna unit in the radio wave radiating direction so as to suppress the influence of the radio wave characteristic. Therefore, by inclining the supporting bars as described above, the center of gravity of the antenna unit can be drawn close to the axis of rotation of the antenna unit. Thus, the antenna unit can be supported stably.

Another aspect of the present invention provides a method of manufacturing radar antennas. The method includes disposing one of a cable and a waveguide in a hollow section of a supporting bar that supports an antenna unit and separates the antenna unit from a housing, so as to connect one of the cable and the waveguide with the antenna unit. The method also includes attaching to the supporting bar the antenna unit provided with dielectric bodies in a front part thereof in a radio wave radiating direction.

Thus, since one of the cable and the waveguide is not exposed outside, the environmental resistance of the cable or the like can be improved. Additionally, since a member for protecting the cable can be omitted or simplified, a cost reduction can be achieved. Moreover, the contour of the radar antenna can be simplified.

BRIEF DESCRIPTION OF THE DRAWINGS

The present disclosure is illustrated by way of example and not by way of limitation in the figures of the accompanying drawings, in which the like reference numerals indicate like elements and in which.

DETAILED DESCRIPTION

Figure 1:
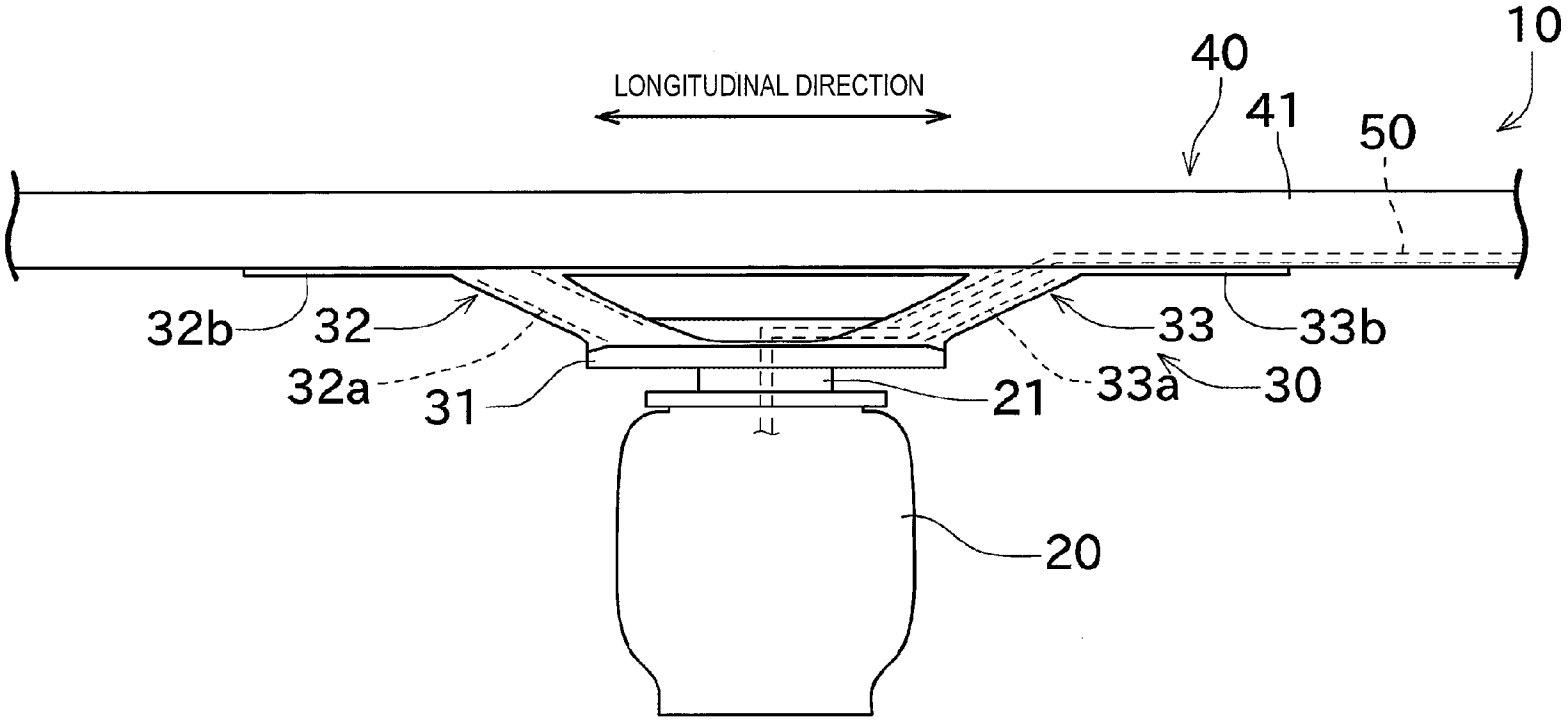
FIG. 1 is a schematic front view of a radar antenna according to one embodiment of the present invention.
Figure 2:
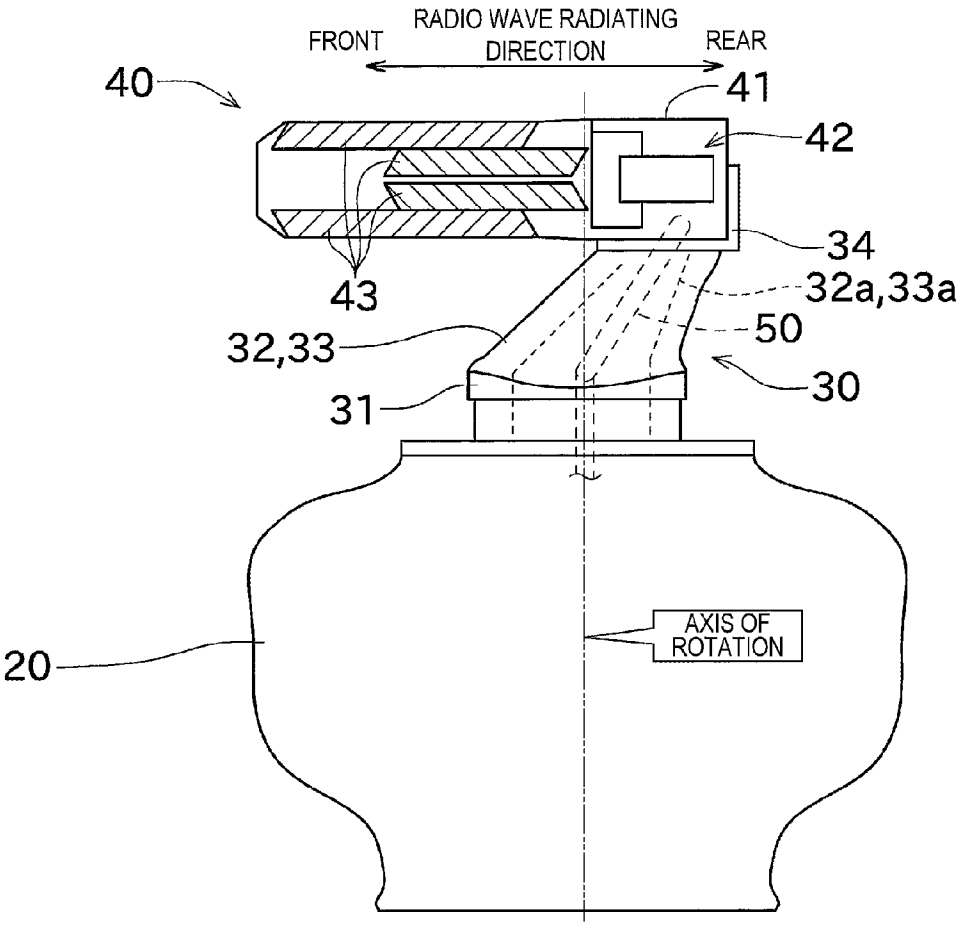
FIG. 2 is a schematic side view of the radar antenna.

Next, one embodiment of the present invention is described with reference to the accompanying drawings. FIG. 1 is a schematic front view of a radar antenna according to this embodiment of the present invention. FIG. 2 is a schematic side view of the radar antenna.

A radar antenna 10 radiates pulse-shaped radio waves and receives reflection waves of the radiated radio waves. The radar antenna 10 repeats transception of the radio waves while rotating in the horizontal plane. Each reflection wave received by the radar antenna 10 is analyzed by a transceiver, an indicator and the like (not illustrated). Thus, a position, a speed and the like of a target object existing around the radar antenna 10 can be obtained.

As illustrated in FIGS. 1 and 2, the radar antenna 10 includes a housing unit 20, an antenna supporting unit 30, and an antenna unit 40 having dielectric bodies.

The housing unit 20 is a box-like member accommodating various components. The housing unit 20 includes a motor for driving a rotational shaft 21 for rotating the antenna unit 40, and a circuit and a magnetron for generating the radio wave to be radiated from the antenna unit 40. Moreover, the housing unit 20 is connected with the antenna unit 40 via a coaxial cable (or a waveguide, etc.), and the antenna unit 40 can radiate outside the radio wave supplied from the housing unit 20.

As described above, the antenna unit 40 having the dielectric bodies cannot appropriately form a beam if a metal exists on a front side or obliquely front side thereof in a radio wave radiating direction. In this embodiment, considering this point, the antenna supporting unit 30 made of FRP (Fiber Reinforced Plastic) is provided. In this embodiment, a forward direction of the radio wave radiating direction corresponds to a forward direction of the antenna unit 40, and a backward direction of the radio wave radiating direction corresponds to a rearward direction of the antenna unit 40.

The antenna supporting unit 30 separates the antenna unit 40 from the housing unit 20 by supporting bars 32 and 33 described later. Thus, the influence that the housing unit 20 gives the beam formation can be reduced. Note that, the separating amount is preferred to correspond to one wavelength or more of the radio wave to be radiated (about 10 cm when the transmission frequency is 3 GHz). Moreover, since FPR has a characteristic that it does not easily influence radio waves, the beam formation is rarely influenced. Note that, among various kinds of FRP, GFRP (Glass Fiber Reinforced Plastic) is preferred to be the material of the antenna supporting unit 30 considering the influence on radio waves.

Moreover, FRP (GFRP) excels in its light weight, thermal resistance, and corrosion resistance, as well as having a small influence on radio waves. Especially, since this embodiment is applied to a ship radar apparatus, FRP is suitable considering the possibility of receiving strong wind and seawater.

Figure 3:
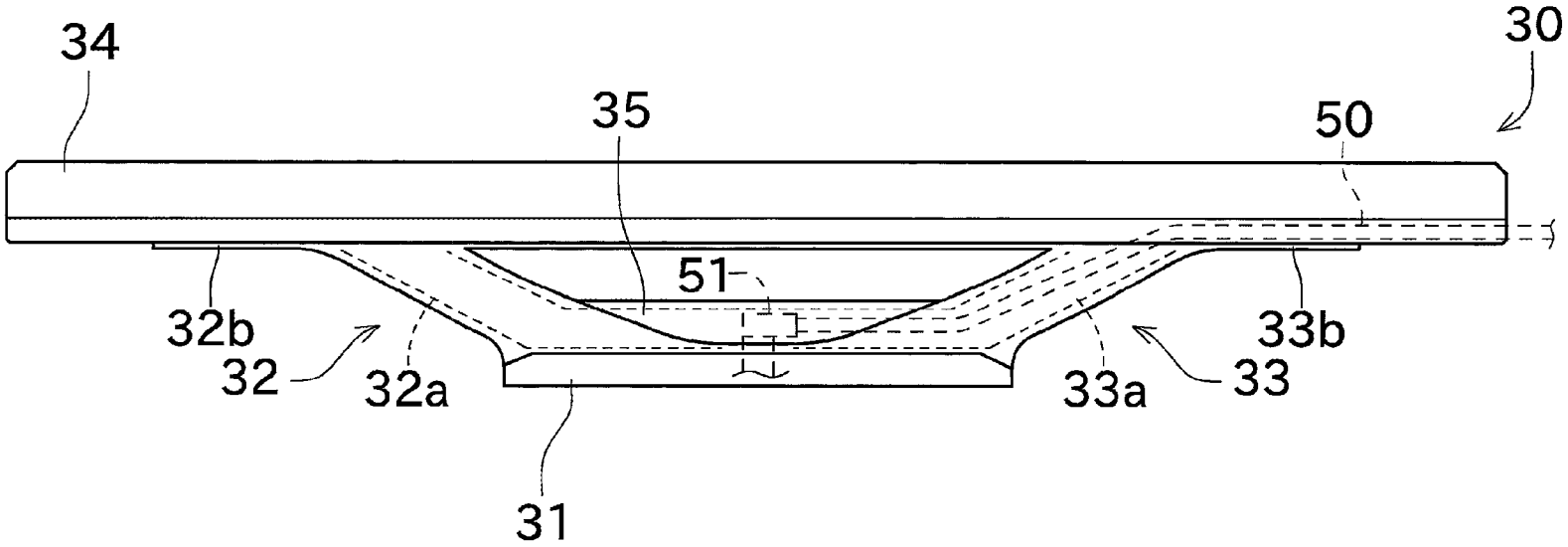
FIG. 3 is a front view of an antenna supporting part.
Figure 4:
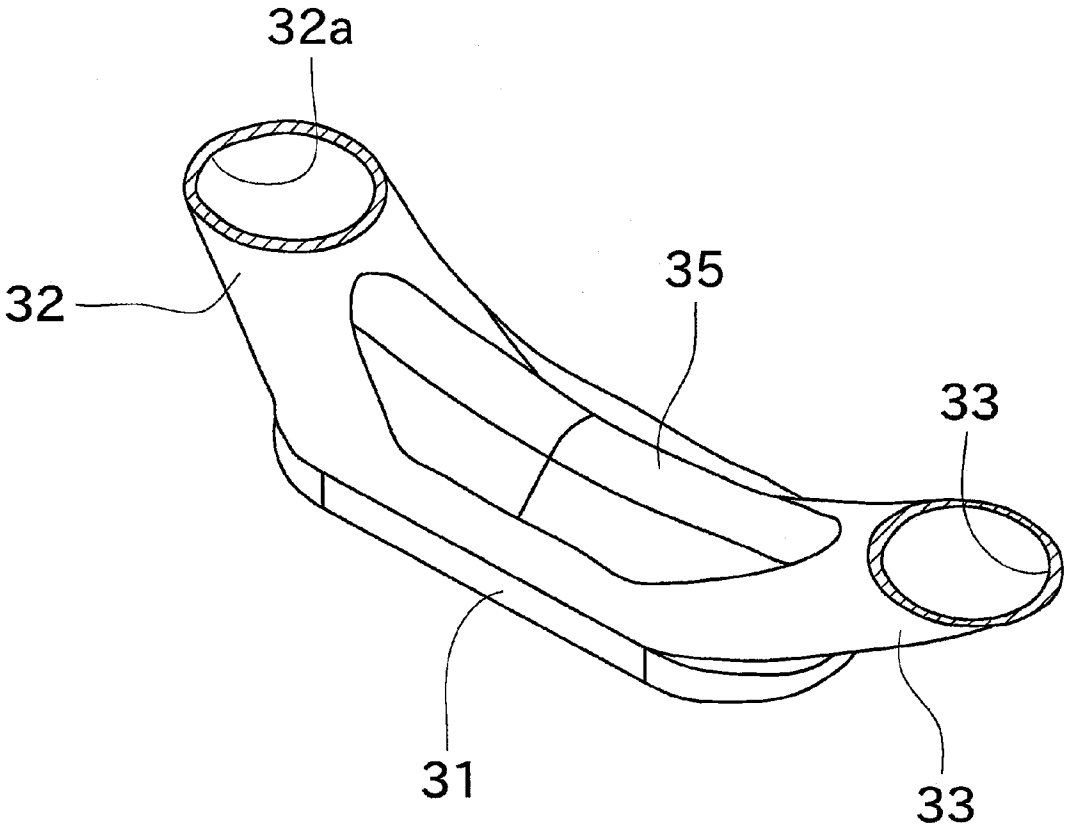
FIG. 4 is a cross-sectional perspective view of the antenna supporting part.

Hereinafter, a specific configuration of the antenna supporting unit 30 is described. As illustrated in FIGS. 1 and 3, the antenna supporting unit 30 includes a pedestal 31, supporting bars 32 and 33, an attaching base 34, and a cover 35. Moreover, the pedestal 31, the supporting bars 32 and 33, the attaching base 34, and the cover 35 rotate integrally with the antenna unit 40. Further, the supporting bar 32 is formed with a hollow section 32*a* and a fixed portion 32*b*, and the supporting bar 33 is formed with a hollow section 33*a* and a fixed portion 33*b*.

The pedestal 31 is a plate-like member attached to the housing unit 20. The pedestal 31 is connected with the two supporting bars 32 and 33.

The supporting bars 32 and 33 are cylindrical members (members with cylindrical contours) and are formed to connect the pedestal 31 with the attaching base 34. Moreover, the supporting bars 32 and 33 are arranged such that a gap between the supporting bars 32 and 33 is wider on the attaching base 34 side (antenna unit 40 side) than the pedestal 31 side (arranged in a substantially V-shape). In other words, the supporting bars 32 and 33 incline toward different end parts of the attaching base 34 (antenna unit 40) from each other in the longitudinal direction of the attaching base 34 (see FIG. 1) (incline in the longitudinal direction of the antenna unit 40).

Moreover, as illustrated in FIG. 2, the supporting bars 32 and 33 extend to the attaching base 34 (antenna unit 40) while inclining toward a rear part of the antenna unit 40 (backward in the radio wave radiating direction) for the following reasons.

That is, with the antenna unit 40 having the dielectric bodies, in order to prevent the influence on the beam formation, it is not preferred to locate the antenna supporting unit 30 at a front part of the antenna unit 40 in the radio wave radiating direction. Therefore, the antenna supporting unit 30 (supporting bars 32 and 33) supports the rear part of the antenna unit 40.

Therefore, if the antenna supporting unit 30 (supporting bars 32 and 33) extends straight with no inclination, the center of gravity of the antenna unit 40 will be largely offset from an axis of rotation of the antenna unit 40. In this case, it becomes difficult to stably support the antenna unit 40 that is rotating.

In this regard, in this embodiment, by inclining the supporting bars 32 and 33 backward in the radio wave radiating direction, the center of gravity of the antenna unit 40 can be drawn close to the axis of rotation of the antenna unit 40. Therefore, the antenna 40 that is rotating can be stably supported.

The hollow sections 32*a* and 33*a* are hollow areas of the cylindrical supporting bars 32 and 33. A plurality of layers of FRP are required to be formed so as to thicken the respective members of the antenna supporting unit 30. Therefore, the manufacturing cost is cheaper to create a hollow member than to create a solid member.

The fixed portions 32*b* and 33*b* are plate-like portions formed at contacting positions with the attaching base 34. A through hole is formed in each of the fixed portions 32*b* and 33*b*, and by inserting a fixing tool (e.g., a bolt) into the through hole to be attached thereto, the supporting bars 32 and 33 can be fixed to the attaching base 34.

The attaching base 34 is disposed between the supporting bars 32 and 33, and the antenna unit 40. The attaching base 34 is a long-and-thin member having an L-shaped cross-section, and is attached to the antenna unit 40 by contacting a lower surface (surface on the housing unit 20 side) and a rear surface (surface on the backward side in the radio wave radiating direction) of the antenna unit 40. Note that, by forming the attaching base 34 to have the L-shaped cross-section, the antenna unit 40 can surely be fixed and the strength of the attaching base 34 can be improved.

The cover 35 covers a section between the supporting bar 32 and the supporting bar 33.

The antenna unit 40 is an end-feed-type slot array antenna and can radiate the radio wave in the direction indicated by the arrow (forward arrow) in FIG. 2. As illustrated in FIG. 2, the antenna unit 40 includes an antenna case 41, a radiating part 42, and a plurality of dielectric body parts 43.

The antenna case 41 is a case for covering the respective members configuring the antenna unit 40. Note that, to facilitate the view inside the radar antenna 10, the antenna case 41 is only illustrated about its contour in FIG. 2.

The radiating part 42 radiates outside the radio wave supplied from, for example, the coaxial cable. The radiating part 42 is comprised of a radiation waveguide formed in the longitudinal direction of the antenna unit 40. The radiation waveguide is a tubular member made of metal, where slits are formed at a predetermined interval. The radiation waveguide radiates outside (in the radio wave radiating direction) through the slits, the radio wave supplied from, for example, the coaxial cable.

The dielectric body parts 43 made of foamed dielectric bodies are disposed in the front part of the antenna unit 40 in the radio wave radiating direction. Specifically, two plates of the dielectric bodies are disposed parallel to each other via a predetermined interval therebetween, and two other plates of the dielectric bodies are disposed outward thereof, respectively. A directivity angle (a beam width in a perpendicular direction) of the radio wave radiated from the radiating part 42 is controlled according to the interval of the dielectric body parts 43. Note that, the directivity angle can also be adjusted by changing a permittivity of the dielectric body parts 43, in addition to the interval of the dielectric body parts 43.

According to the configuration described above, the radar antenna 10 can radiate outside the radio wave generated by using the magnetron and the like at a predetermined directivity angle.

Next, an arrangement of the coaxial cable connecting the housing unit 20 with the antenna unit 40 is described.

As described above, the housing unit 20 is provided with the magnetron, a circuit or the like for generating the radio wave to be radiated by the antenna unit 40. The radio wave generated here is supplied to the antenna unit 40 by the coaxial cable 50. Specifically, as illustrated in FIG. 2, a hole is formed in a top face of the housing unit 20 (face on the antenna unit 40 side) and the coaxial cable 50 extends from the housing unit 20 to the antenna supporting unit 30 through the hole.

As illustrated in FIG. 3, a connector 51 is disposed inside the cover 35 of the antenna supporting unit 30. The connector 51 is a component for connecting a part of the coaxial cable 50 extending from the housing unit 20, with a part of the coaxial cable 50 extending toward the antenna unit 40.

The part of the coaxial cable 50 extending toward the antenna unit 40 from the connector 51 passes through inside the supporting bar 33 (hollow section 33*a*) to be connected with the radiating part 42 of the antenna unit 40. By this configuration, the radio wave generated by the housing unit 20 can be supplied to the antenna unit 40.

Next, the configuration of this embodiment where the coaxial cable 50 passes through inside the supporting bar 33 is compared with a configuration (comparative embodiment) in which the coaxial cable 50 passes outside the antenna supporting unit 30.

In the comparative embodiment, the coaxial cable 50 is exposed outside. Therefore, countermeasures for, for example, ultraviolet rays, wind, and water immersion need to be implemented on the coaxial cable 50. In this regard, in the above embodiment, since the coaxial cable 50 is covered by the supporting bar 33, no such countermeasures are needed. Therefore, the cost of the radar antenna 10 can be reduced.

Moreover, in the comparative embodiment, since the coaxial cable 50 is exposed outside, the radar antenna will give an untidy impression in view of the design. In this regard, in the above embodiment, since the coaxial cable 50 is not exposed outside, the design can be tidy (simple).

Further, since the antenna unit 40 is the end feed type, the coaxial cable 50 is required to be arranged to reach an end part of the antenna unit 40. Moreover, it is preferred that the coaxial cable 50 is not bent sharply. Therefore, ideally, the coaxial cable 50 is arranged to gradually curve as illustrated in FIG. 3. However, in the comparative embodiment, such a gradual-curving arrangement of the coaxial cable 50 would cause a longer portion of the coaxial cable 50 to be exposed. In this case, the cost performance and the design of the radar antenna 10 will further degrade.

In this regard, by arranging the coaxial cable 50 to pass through inside the supporting bar 33 inclining toward the end part of the antenna unit 40 in the longitudinal direction as the above embodiment, an ideal arrangement of the coaxial cable 50 can be realized. That is, the configuration of this embodiment is particularly effective to the antenna unit 40 of the end feed type.

As described above, the radar antenna 10 of this embodiment includes the antenna unit 40, the pedestal 31, the supporting bars 32 and 33, and the coaxial cable 50. The antenna unit 40 is provided with the dielectric body parts 43 in the front part thereof in the radio wave radiating direction. The supporting bars 32 and 33 are attached between the antenna unit 40 and the pedestal 31 to separate the antenna unit 40 from the pedestal 31. The supporting bars 32 and 33 are formed with the hollow sections 32*a* and 33*a* therein, respectively. The coaxial cable 50 passes through the hollow section 33*a* to be connected with the antenna unit 40.

Thus, since the coaxial cable 50 is not exposed outside, the environmental resistance of the coaxial cable 50 can be improved. Additionally, since a member for protecting the coaxial cable 50 can be omitted or simplified, a cost reduction can be achieved. Moreover, the design of the radar antenna 10 can be simplified.

Although the preferred embodiment of the present invention is described above, the above configuration may be modified as follows.

In the above embodiment, the configuration in which the coaxial cable 50 passes through the hollow section 33*a* is disclosed; however, various cables other than the coaxial cable 50 can also pass therethrough, for example, the configuration may be such that a certain sensor is attached to the antenna unit 40 and cables for feeding power to the sensor and transmitting information pass through the hollow section.

Moreover, the waveguide may pass through the hollow section instead of the coaxial cable 50. Note that, since the waveguide is not preferred to be bent, such a configuration is preferred to be applied to a center-feed-type antenna.

The number of the supporting bars 32 and 33 is not limited to two, but may be one, three or more.

The installing angles of the supporting bars 32 and 33 are arbitrary and the supporting bars 32 and 33 do not need to incline backward in the radio wave radiating direction while inclining toward the end parts of the antenna unit 40 in the longitudinal direction. Moreover, the shapes of the supporting bars 32 and 33 are arbitrary as long as the hollow sections 32*a* and 33*a* are respectively formed therein, and the shapes may be rectangular pipe-like shapes.

The present invention is not limited to the radar antenna for ships but may also be applied to radar antennas provided to other movable bodies (navigation bodies, such as automobiles, airplanes, etc.). Moreover, the present invention may also be applied to radar antennas of radar apparatuses which perform observation at fixed positions.

In the foregoing specification, specific embodiments of the present invention have been described. However, one of ordinary skill in the art appreciates that various modifications and changes can be made without departing from the scope of the present invention as set forth in the claims below. Accordingly, the specification and figures are to be regarded in an illustrative rather than a restrictive sense, and all such modifications are intended to be included within the scope of present invention. The benefits, advantages, solutions to problems, and any element(s) that may cause any benefit, advantage, or solution to occur or become more pronounced are not to be construed as a critical, required, or essential features or elements of any or all the claims. The invention is defined solely by the appended claims including any amendments made during the pendency of this application and all equivalents of those claims as issued.

What is claimed is:

1. A radar antenna, comprising:

an antenna unit provided with dielectric bodies in a front part thereof in a radio wave radiating direction, and having an elongated shape in a front view;

a housing unit including a motor configured to rotate the antenna unit horizontally;

a pedestal attached to the housing unit and placed thereon;

at least two supporting bars attached between the antenna unit and the pedestal to upwardly support the antenna unit and to separate the antenna unit from the housing unit under the pedestal, and formed with a hollow section therein;

a gap between the supporting bars that becomes wider with increasing proximity toward the antenna unit; and one of a cable and a waveguide passing through the hollow section of one of the at least two supporting bars and connected with the antenna unit, wherein the pedestal and the supporting bar are configured to rotate integrally with the antenna unit.

2. The radar antenna of claim 1, wherein the supporting bar inclines in a longitudinal direction of the antenna unit.

3. The radar antenna of claim 1, wherein the supporting bar consists of two supporting bars, and a gap between the supporting bars becomes wider toward the antenna unit.

4. The radar antenna of claim 3, wherein the two supporting bars incline in a longitudinal direction of the antenna unit.

5. The radar antenna of claim 1, wherein the supporting bar includes a plurality of supporting bars, and wherein the hollow section is formed in at least one of the plurality of supporting bars.

6. The radar antenna of claim 5, wherein at least one of the plurality of supporting bars incline in a longitudinal direction of the antenna unit.

7. The radar antenna of claim 1, wherein the antenna unit is an end feed type, and wherein the hollow section of the supporting bar contains a coaxial cable therein.

8. The radar antenna of claim 1, further comprising a housing unit formed with a hole, wherein one of the cable and the waveguide is disposed to pass through the hole formed in the housing unit, and the hollow section formed to penetrate the supporting bar.

9. The radar antenna of claim 1, wherein the supporting bar inclines toward a rear part of the antenna unit in the radio wave radiating direction.

10. A method of manufacturing radar antennas, comprising:

disposing one of a cable and a waveguide in a hollow section of at least one of multiple supporting bars that upwardly support an antenna unit and separates the antenna unit from a housing unit under a pedestal, so as to connect one of the cable and the waveguide with the antenna unit;

attaching to the supporting bars the antenna unit provided with dielectric bodies in a front part thereof in a radio wave radiating direction, and having an elongated shape in a front view, and attaching a pedestal to the supporting bar and the housing unit, placing the pedestal on the housing unit, wherein the housing unit includes a motor configured to rotate the antenna unit horizontally, such that the pedestal and the supporting bar are configured to rotate integrally with the antenna unit, and wherein a gap between the supporting bars becomes wider with increasing proximity toward the antenna unit.

11. The method of claim 10, wherein the antenna unit is attached to the supporting bar so as to incline the supporting bar toward a rear part of the antenna unit in the radio wave radiating direction.

12. The radar antenna of claim 1, wherein at least three supporting bars are attached between the antenna unit and the pedestal to upwardly support the antenna unit and to separate the antenna unit from the housing unit under the pedestal.

* * * * *